US006203377B1

(12) United States Patent
Grek et al.

(10) Patent No.: US 6,203,377 B1
(45) Date of Patent: Mar. 20, 2001

(54) CONNECTOR AND A METHOD FOR ASSEMBLING THE CONNECTOR

(75) Inventors: Ivan Joachim Grek, Katrineholm (SE); Andrew Graham Meller, Hertogenbosch (NL)

(73) Assignee: FCI Katrineholm A.B., Katrineholm (SE)

( * ) Notice: Subject to any disclaimer, the term of this patent is extended or adjusted under 35 U.S.C. 154(b) by 0 days.

(21) Appl. No.: 09/494,157

(22) Filed: Jan. 28, 2000

(30) Foreign Application Priority Data

Jan. 29, 1999 (SE) ..... 9900299

(51) Int. Cl.[7] ..... H01R 9/03
(52) U.S. Cl. ..... 439/610
(58) Field of Search ..... 439/98, 585, 610

(56) References Cited

U.S. PATENT DOCUMENTS

| | | | | |
|---|---|---|---|---|
| 4,194,805 | * | 3/1980 | Ayer et al. | 339/107 |
| 4,640,569 | * | 2/1987 | Dola et al. | 339/143 |
| 4,854,895 | * | 8/1989 | Komatsu | 439/610 |
| 4,902,249 | | 2/1990 | Morishita et al. | 439/610 |
| 4,963,104 | | 10/1990 | Dickie | 439/460 |
| 5,180,316 | * | 1/1993 | Miller et al. | 439/610 |
| 5,267,878 | * | 12/1993 | Shinji et al. | 439/610 |
| 5,460,544 | * | 10/1995 | Inaba et al. | 439/578 |
| 5,498,176 | * | 3/1996 | Hashizawa et al. | 439/585 |
| 5,823,803 | | 10/1998 | Majors | 439/98 |

FOREIGN PATENT DOCUMENTS

| | | |
|---|---|---|
| 0062760 A1 | 10/1982 | (EP) . |
| 0858133 A2 | 8/1998 | (EP) . |
| 2097601 | 11/1982 | (GB) . |

* cited by examiner

*Primary Examiner*—Lincoln Donovan
*Assistant Examiner*—Thanh-Tam Le
(74) *Attorney, Agent, or Firm*—Perman & Green, LLP

(57) ABSTRACT

A connector for a cable (3) with at least one conductor (5) and a shielding (7), which connector (9) comprises a cover means (12, 14) designed for electrical communication, and a connecting means (13) connectable to the shielding (7) and the cover means (12, 14). Said connecting means (13) comprises an outer ferrule (15) of which a first part (17) is crimped onto said cable (3) for fastening said connecting means (13) to said cable (3) and a second part (19) is crimped onto said shielding (7) for electrical communication.

9 Claims, 4 Drawing Sheets

CONNECTOR AND A METHOD FOR ASSEMBLING THE CONNECTOR

TECHNICAL FIELD OF THE INVENTION

Figure 1:
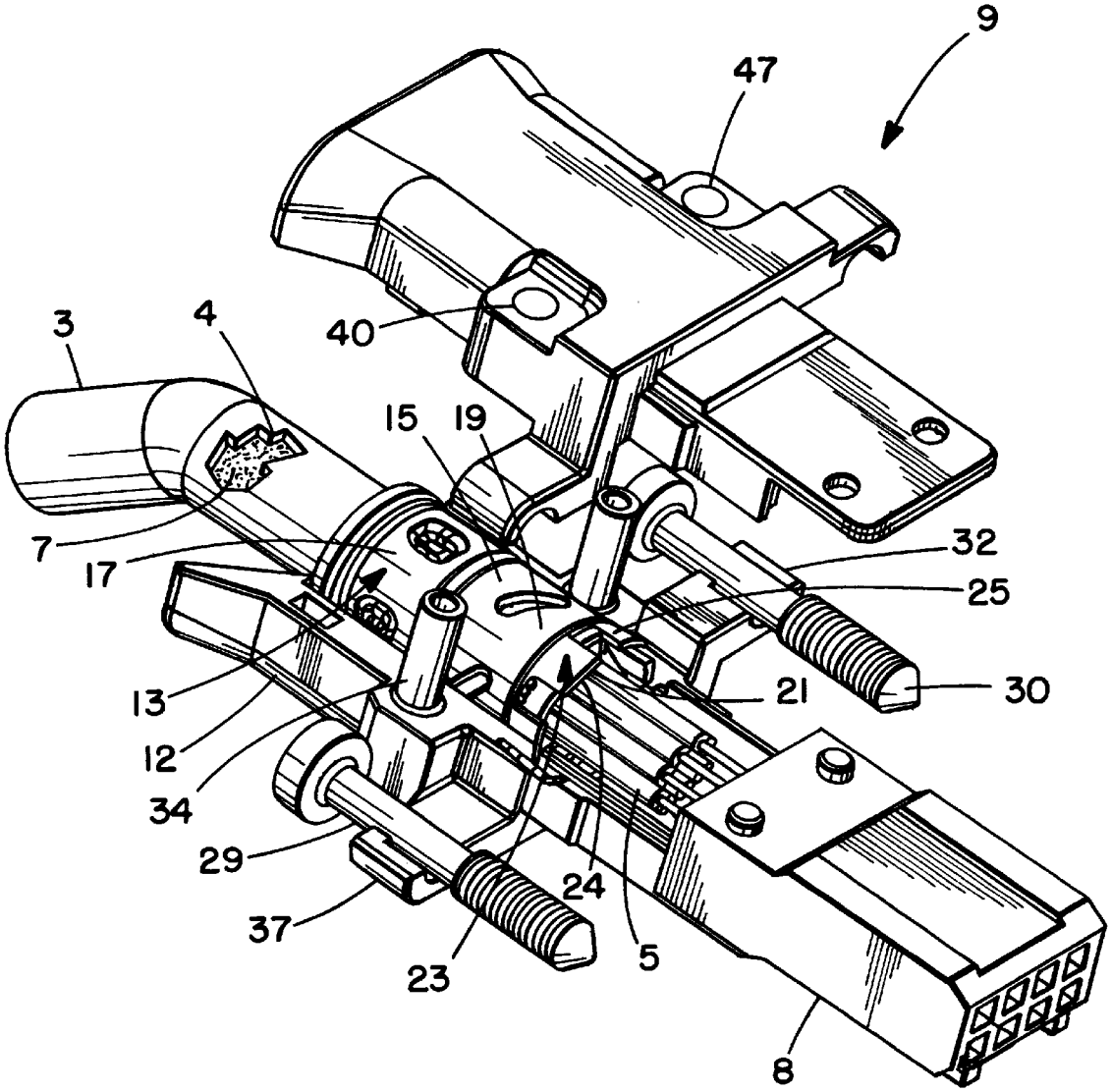

The present invention relates to a connector, in accordance with the preamble of claim 1, and a method, according to the preamble of claim 8, for assembling the connector.

Known methods for assembling shielded cable connectors, as, for example, the one disclosed in U.S. Pat. No. 4,902,249, suffers from the disadvantage that the assembling process time is long, causing a high manufacturing cost.

According to one of the prior art methods, it is difficult to assemble the connector, as in this specific technique two spring washers are needed, for contacting the shielding of the cable and the cover of the cable connector for EMC-protection.

The two washers, according to this known technique, causes also a "step" to pass for the electrical signals, which causes ineffectiveness and reduction in performance, when used for high-speed signals.

Also ferrules, according for example to U.S. Pat. No. 4,902,249, cause disturbances of the signals in the connection area between the shielding and the cover in the connector, that means that the electrical signals from the earth screen, have to go backward via a squeezed metal ferrule and furthermore forward to the cover of the connector.

Known cable connectors, suffers furthermore from the disadvantage that existing racks do not allow larger dimensions for the cables, since the connectors, according to known techniques already are in a tight position between each other when maled. Larger dimension of the cable gives a better signal performance. It is also a problem for operating personnel to get their fingers around the connector, since there is no sufficient space between the connectors, when mounted in the rack.

Furthermore rivets, according to known technique, have to be mounted before or after the assembly process of the connectors for riveting. This causes a complicated assembly of the connector and high costs.

Screws, according to known technique, for fastening the connector to the rack have to be screwed through threads in the connector after the assembly process of the cable and the connector. This also causes a high mounting cost.

It is, accordingly, an object of the invention to overcome the disadvantages of the known devices and methods. That is, primary, to decrease the assembling time and the complexity of the connector and furthermore to improve the electrical characteristics for shielding and grounding function.

SUMMARY OF THE INVENTION

The above mentioned objects have been solved by a connector as defined in the introduction, which is characterized in that the connecting means comprises an outer ferrule of which a first part is crimped onto the cable jacket for fastening the connecting means to the cable and a second part is crimped onto the cable shielding for electrical communication, while a third part makes electrical connection to the connector shielding.

Hereby the electrical signals can be transported in a substantially smooth and straight direction, that means that improved electrical characteristics for the shielding and grounding function have been provided. Furthermore the surface-treatment of the covers will be much easier, as there is no small slot in which the electrical connection takes place.

Suitably, the connecting means comprises an inner ferrule fastened substantially under the shielding to the outer ferrule in the area of the second part for making an axial locking between the outer ferrule and the cover means by means of at least one holding member at the inner ferrule. In this way the cable can be locked in an axial direction in relation to the connector.

Preferably, the at least one tongue member forming said third part at the end of said second part is in contact with said cover means, and which at least one tongue member is oriented in an elongated direction of said outer ferrule for making a smooth and straight member for electrical communication. Hereby the signals can have an even and direct way from the cable shielding to the cover halves and vice versa.

Suitably, the at least one holding member of the inner ferrule is locked in a recess of the outer ferrule and the cover for making the connecting means non-rotatably. An advantage of this arrangement is that the cable is prevented to rotate relatively to the connector body.

Preferably, the at least one holding member is arranged substantially normal to the width of said connector, which width then is minimized, for making space around said connector. This allows that cables with bigger dimension can be connected to the connector according to the invention, since the connection means according to the invention compared with known connection means, makes it possible to use cables with bigger dimension, without increasing the width of the connector. Using bigger dimension of the cables leads to an improved signalling capacity. This also leads to improved electrical characteristics for the shielding and grounding function. Furthermore may a reduction of the size of the connectors for existing cable dimensions be provided, which makes more space between adjacent cable connectors according to the invention. This makes it possible to get your fingers around the cable connector body in a god manner, without forcing operating personal to pull on the cable when disconnecting the cable connector from for example a PCB connector.

Suitably, the cover means is made of zinc. Hereby a conductive material for the shielding and grounding function is provided.

Preferably, rivets are made integral with one of said cover means. This means that the assembly-time is decreased and that no mounting of the rivets to the cover halves is needed. The rivets may be cast integral with the cover.

The connector, according to the invention, is furthermore assembled by a method described below. The disadvantages of the known methods have been solved by a method as defined in the introduction, which is characterized by fitting an outer ferrule onto the cable, stripping a part of the jacket of the cable, cutting a part of the shielding for providing the shielding substantially the length of a second part of the outer ferrule, fitting an inner ferrule over the at least one conductor and under the shielding, sliding the outer ferrule back over the inner ferrule within the area of the second part, crimping the outer ferrule onto the inner ferrule, thereby trapping the cable shielding and making an electrical connection to the ferrules, and onto the cable jacket at the same time or substantially at the same time, terminating the at least one conductor into the terminal block, mounting the terminal block with the fitted cable and ferrules into the bottom cover and mounting the top cover to the bottom cover.

Hereby the assembly-time for the assembly is decreased compared with known assemblies, due to that the crimping can be done in one step. Furthermore other steps according to the invention, compared with known methods, means shorter assembly-time.

Preferably, the mounting of at least two screws into said bottom cover takes place before fitting said top cover to said bottom cover. The threads of the screws have also a function of stopping the screws to fall out during transport. Hereby the assembly-time is additionally decreased compared with known methods.

Suitably, wherein said top cover is fitted to said bottom cover by means of deforming the head of rivets, which are integrated in the bottom or top cover. The rivets may be cast integral with the cover. This means that the assembly-time is further decreased. The integrated rivets leads to that the manufacturing of the cover and rivets is more uncomplicated, since no mounting of the rivets to the halves has to be done. Further more it is easier fitting the two cover halves together, since the rivets already are in their position.

DRAWING SUMMARY

Figure 2A:
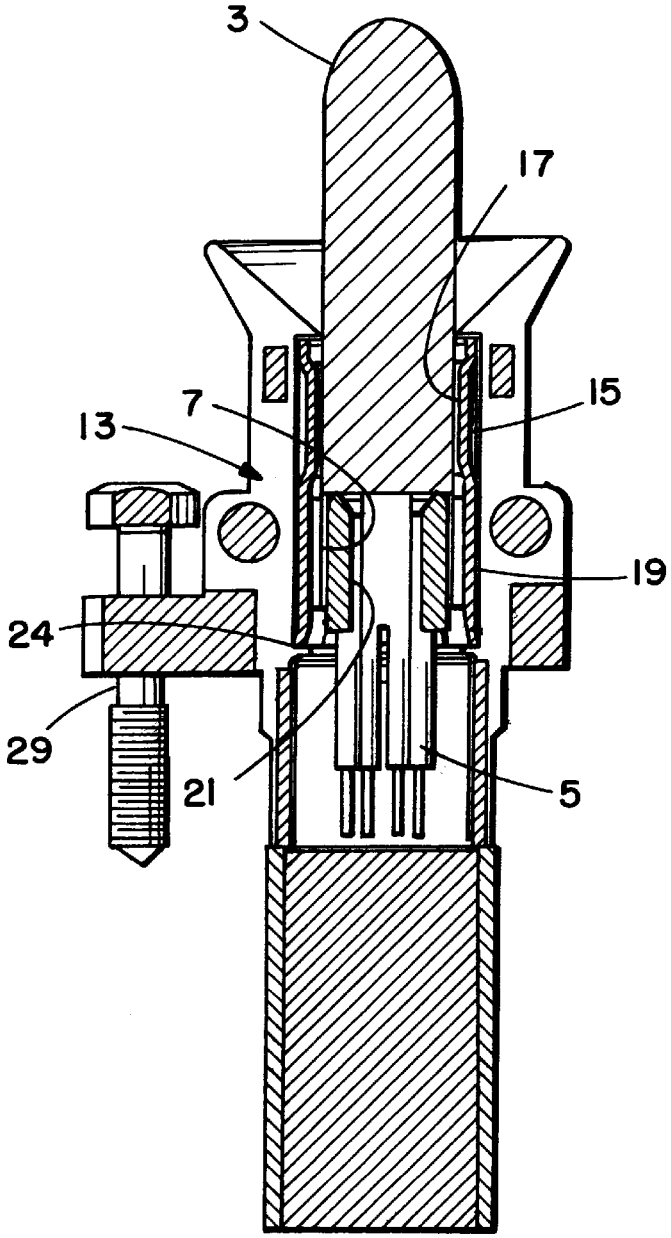
Figure 2B:
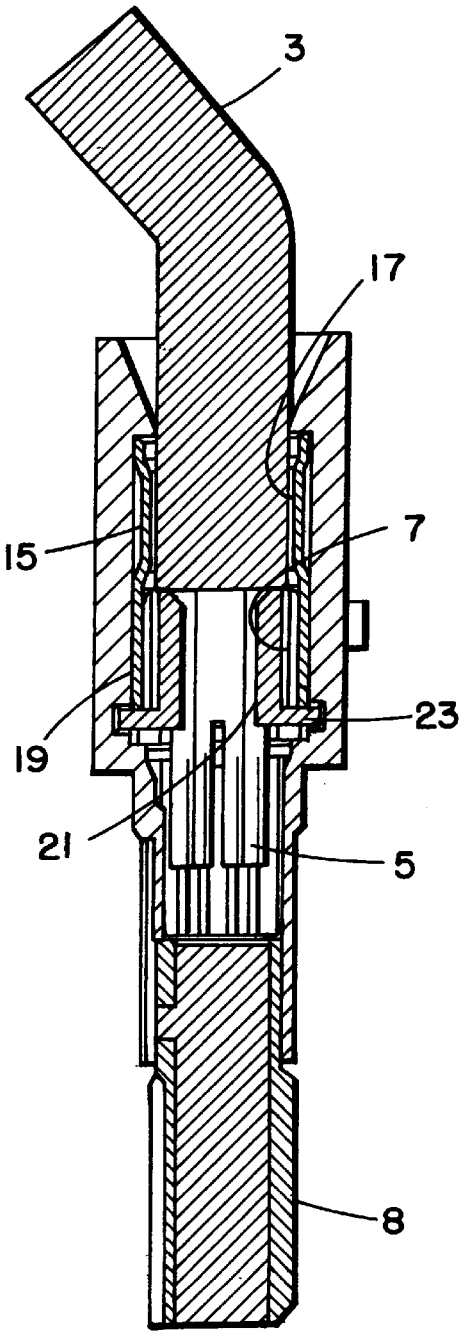

The invention will now be described more closely by means of an example of an embodiment with reference to the accompanying drawings, in which FIG. 1 illustrates in a view of perspective a connector according to the invention, FIG. 2*a* illustrates a cross section of the connector in FIG. 1, FIG. 2*b* illustrates a cross section of the connector in FIG. 2*a,*

Figure 3:
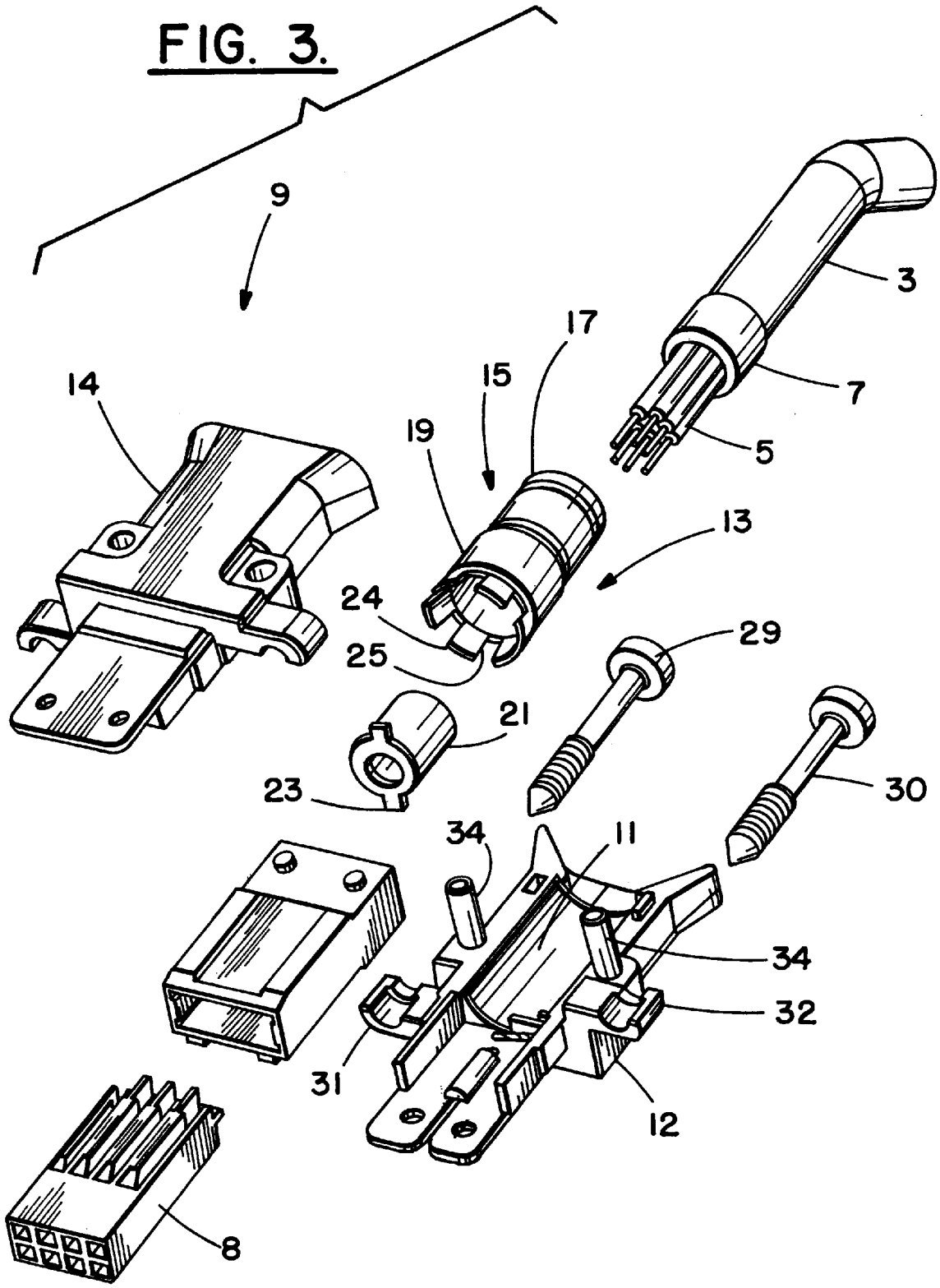
Figure 4:
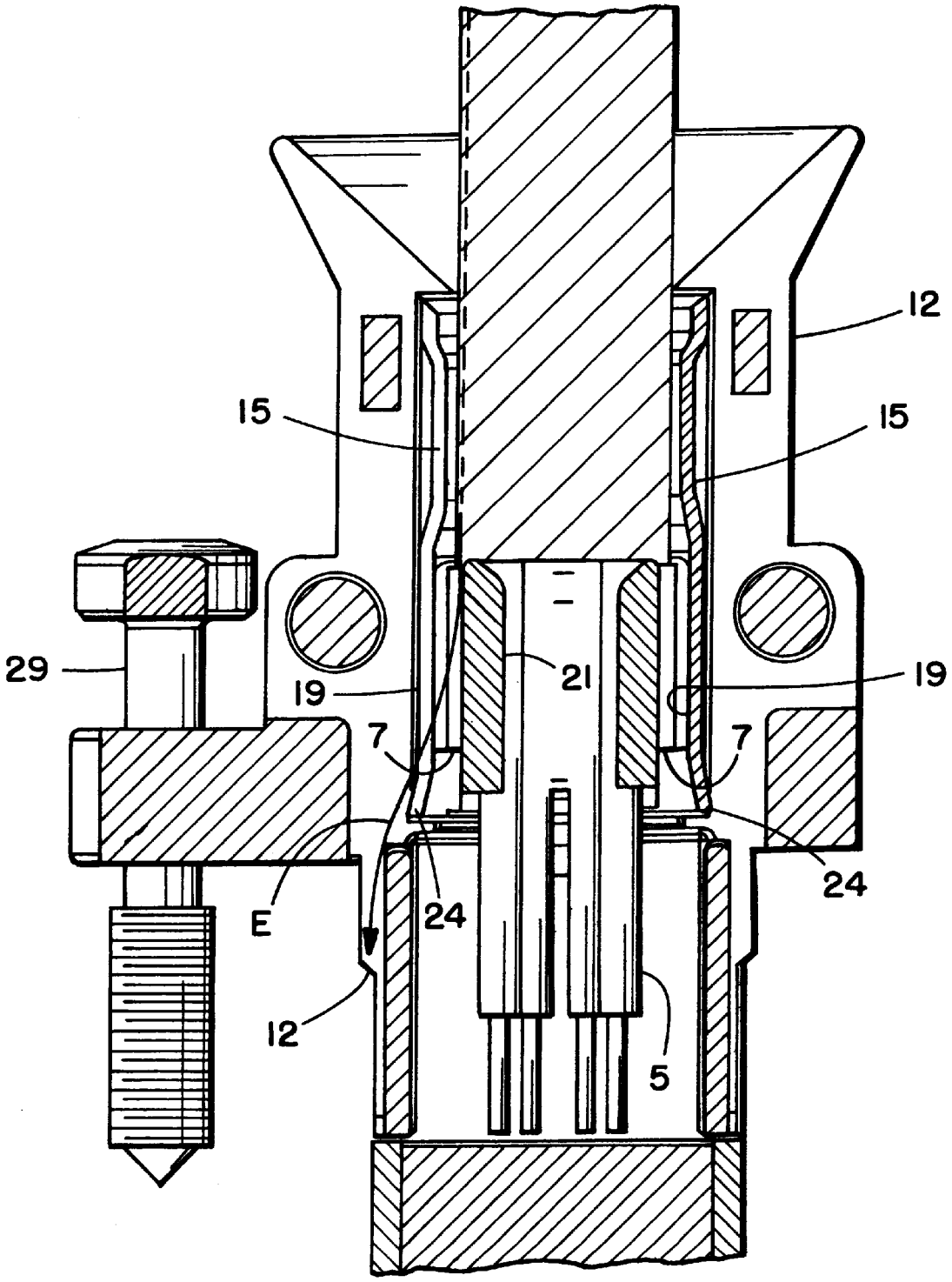

FIG. 3 illustrates a exploded view of the connector according to the invention, FIG. 4 illustrates an enlarged view of the cross section in section 2*a*.

DETAILED DESCRIPTION OF THE INVENTION

Referring to FIGS. 1, 2*a,* 2*b* and 3, according to the invention, for connection to a cable 3, with a number of conductors 5 within a, for example, braided shielding 7, a connector 9 comprises first and second cover halves 12, 14, which are designed for electrical communication. The cover halves 12, 14 can be made of zinc. They are designed for making a connection between a connection means 13, which, according to the invention, is an outer ferrule 15, which is in contact with the braided shielding 7 of the cable 3, and a socket (not shown) in a rack (not shown). According to the invention the surfaces 11 of the cover halves 12, 14 can be made even and smooth, with no slots or other sharp members in the electrical path. This means that an easier manufacturing process is provided and that the thickness of the surface of the cover halves 12, 14 is easier to make with an even thickness. This means furthermore improved electrical characteristics for shielding and grounding function. The cover halves 12, 14 are in FIG. 1 mechanically connectable to a terminal block 8.

The connector comprises furthermore an inner ferrule 21, which is located under the shielding 7 of the cable 3, that is between the shielding 7 and the conductors 5. In FIG. 1 the shielding 7 is illustrated in a cut of the jacket 4. A first part 17 is crimped onto the jacket 4 of the cable 3 and a second part 19 is crimped onto the shielding 7. That means that the jacket 4 is stripped in the area of the second part 19 for making a contact with the shielding 7. The outer ferrule 15 is accordingly to the invention during the assembly process at the same time crimped onto the jacket 4 of the cable 3 and onto respectively the shielding 7 and the inner ferrule 21 with respectively the first part 17 and the second part 19 of the outer ferrule 15.

The inner ferrule 21 is provided with at least one lug 23. At the drawings the inner ferrule 21 is here provided with two lugs 23, which each are located in a recess 25 at the end of the second part 19 of the outer ferrule 15 and in the cover. The lugs 23 are in the FIGS. 1 and 2*b,* seen as illustrated, arranged in a vertical direction in relation to the width for decreasing the width of the connector 9. If the lugs 23 should be arranged horizontally, the height could be decreased instead.

The top cover 14 and a bottom cover 12 have a surface 11 (shown in FIG. 3) inside for electrical communication. The surface 11 could be zinc with a suitable plating (for example copper, nickel, tin etc). The outer ferrule 15 has to be in contact with the surface 11. This is made by means of springing tongues 24 of the outer ferrule 15, which are in contact with the surface 11 of the first and second cover halves 12, 14.

Screws 29, 30, each provided with a threaded and an unthreaded part are located in respectively two ear halves 31, 32 before fitting the top cover 14 to the bottom cover 12. This means that no threads in the ears 31, 32 have to be done. This means that the strength of the ears can be increased, as the ears 31, 32 can be made thicker.

As illustrated in FIGS. 1 and 3, rivets 34 are made in one part with the bottom cover 12. This means that the assembly process can be done more easily than before, since no external rivets have to be pre-mounted in the bottom cover 12 before fitting the bottom cover 12 to the top cover 14.

FIG. 4 illustrates the above described example of the invention, in which parts denoted with a reference sign correspond to parts described in FIGS. 1, 2*a,* 2*b* and 3. FIG. 4 shows by means of an arrow E schematically the smooth and substantial straight path of the electrical signal flow from the braided shielding 7 to the two cover halves 12, 14.

By means of the springing tongues 24, a contact between the outer ferrule 15 and the braided shielding 7 and the cover halves 12, 14 is provided. This means that an electrical communication can take place between the shielding 7 and the cover 12 via the outer ferrule 15 and its springing tongues 24. As the springing tongues 24 have their location in the extension length of the outer ferrule 15, the communication can take place without making any sharp and abrupt transition section.

Operation

Known technique means that the electrical signals have to made a sharp and abrupt transition way in the area between the shielding and the cover. Today used spring washers cause a sharp path for the signals. Also known ferrules causes a non-smooth communication between the shielding and the surface of the cover halves or the cover. It is according to known technique a problem for the surface to have an even thickness all over the area for electrical communication. Known technique means that the crimping operation, during the assembling process, of the ferrules to the jacket must be done in two steps.

According to the invention, the electrical signals, either coming from the cable to the cover or vice versa, can make a smooth and straight path. This leads to an improved electrical performance for, for example, the shielding and the grounding function.

When handling with the cables and the fitted connectors and they, for example, being mounted in a rack, a twisting moment causes rotational forces to the cables and the connectors. According to the invention, the inner ferrule is provided with a member for preventing a rotation of the cable. This member also locks the cable in an axial direction. Also may hooks, arranged to the cover, be used for hooking the outer ferrule to the cover.

The covers may be made with rounded external corners. This will, while plaiting the cables with associated connectors, make the plaiting easier to control, since the covers will not damage each other during, for example, a trumbeling process.

What is claimed is:

1. A connector for a cable (3) with at least one conductor (5) and a shielding (7), which connector (9) comprises a cover means (12, 14) designed for electrical communication, and a connecting means (13) connectable to the shielding (7) and the cover means (12, 14), characterized in that said connecting means (13) comprises an outer ferrule (15) of which a first part (17) is crimped onto said cable jacket (3) for fastening said connecting means (13) to said cable (3) and a second part (19) is crimped onto said cable shielding (7) for electrical communication, while a third part (24) makes electrical connection to said cover means (12, 14), wherein said connecting means (13) also comprises an inner ferrule (21) fastened substantially under said shielding (7) to said outer ferrule (15) in the area of the second part (19) for making an axial locking between said outer ferrule (15) and said cover means (12, 14) by means of at least one holding member (23) at said inner ferrule (21).

2. A connector according to claim 1, wherein at least one tongue member (24) forming said third part at the end of said second part (19) is in contact with said cover means (12, 14), and which at least one tongue member (24) is oriented in an elongated direction of said outer ferrule (15) for making a smooth and straight member for electrical communication.

3. A connector according to claim 1, wherein said at least one holding member (23) of said inner ferrule (21) is locked in a recess (25) of said outer ferrule (15) and said cover means (12, 14) for making said connecting means (13) non-rotatably.

4. A connector according to claim 1, wherein said at least one holding member (23) is substantially arranged normal to the width of said connector (9), which width then is minimized, for making space around said connector (9).

5. A connector according to claim 1, wherein said cover means (12, 14) is made of zinc with a suitably plating.

6. A connector according to claim 1, wherein rivets (34) are integral with one of said cover means (12, 14).

7. A method for assembling a cable (3) with a connector (9) according to claim 1, which cable (3) comprises said at least one conductor (5) and said shielding (7) and which connector (9) comprises said cover means (11) designed for electrical communication, a terminal block (8), a bottom cover (12), a top cover (14) and said connecting means (13) connectable to the shielding (7) and the cover means (11), characterized by fitting said outer ferrule (15) onto said cable (3), stripping a part of the jacket (4) of said cable (3), cutting a part of the shielding for providing said shielding (7) substantially the length of said second part (19) of said outer ferrule (15), fitting an inner ferrule (21) over said at least one conductor (5) and under said shielding (7), sliding said outer ferrule (15) back over said inner ferrule (21) within the area of said second part (19), crimping said outer ferrule (15) onto said inner ferrule (21) for trapping said cable shielding (7) and making an electrical connection to said ferrules (15, 21), and onto said cable jacket (3) at the same time or substantially at the same time, terminating said at least one conductor (5) into said terminal block (8), mounting the terminal block (8) with the fitted cable (3) and ferrules (15, 21) into said bottom cover (12) and mounting said top cover (14) to said bottom cover (12).

8. A method according to claim 7, including the step of mounting at least two screws (29, 30) into said bottom cover (12) before fitting said top cover (14) to said bottom cover (12).

9. A method according to claim 7, wherein said top cover (14) is fitted to said bottom cover (12) by means of deforming the head of rivets (34), which are integrated in the bottom or top cover (12, 14).

* * * * *